United States Patent [19]

Manian

[11] 4,363,439

[45] Dec. 14, 1982

[54] MAIL DELIVERY SIGNAL DEVICE FOR MAILBOXES

[76] Inventor: Harry Manian, 84 NE. 151 St., North Miami Beach, Fla. 33162

[21] Appl. No.: 7,465

[22] Filed: Jan. 29, 1979

[51] Int. Cl.[3] ..... A47G 29/12

[52] U.S. Cl. ..... 232/35; 232/1 C

[58] Field of Search ..... 116/306, 215, 309, 313; 232/1 C, 35

[56] References Cited

U.S. PATENT DOCUMENTS

| | | | |
|---|---|---|---|
| 706,843 | 8/1902 | Moore | 232/35 |
| 820,841 | 5/1906 | Aarseth | 232/35 |
| 903,362 | 11/1908 | Denny | 232/35 |
| 2,478,727 | 8/1949 | Swanson | 232/35 |
| 3,017,073 | 1/1962 | Piergiovani | 232/35 |
| 3,408,978 | 11/1968 | Duffey | 116/215 X |
| 3,960,316 | 1/1976 | Echterling | 232/35 X |
| 4,154,392 | 5/1979 | Galstad et al. | 232/35 |

*Primary Examiner*—Daniel M. Yasich

*Attorney, Agent, or Firm*—Ernest H. Schmidt

[57] ABSTRACT

A mail delivery signal device for detached, rural-type mailboxes wherein an elongated signal arm member, swingably secured along its lower end to a lower front portion of the mailbox so as to lean abuttingly thereagainst at its upper end, falls arcuately downwardly to project beyond the bottom or either side of the mailbox, selectively, upon the door being opened for the delivery of mail, thereby automatically notifying the recipient that mail has been delivered.

4 Claims, 6 Drawing Figures

MAIL DELIVERY SIGNAL DEVICE FOR MAILBOXES

My invention relates to mail delivery signal devices and is directed particularly to such signal device that operates automatically and that is well adapted to being supplied as a kit for the modification of existing mailboxes as well as being incorporated as an integral part of newly manufactured mailboxes.

Various mail delivery signal devices for mailboxes, particularly detached rural mailboxes of the type having a downwardly swingable front access door, have heretofore been devised. Examples of such prior art mailbox signal devices can be found in U.S. Pat. Nos. 3,212,701 to Smith, 2,856,123 to Mary and 2,581,880 to Price. Such prior signal devices have not enjoyed widespread use, however, despite their obvious need, probably because of their complexity and attendant difficulties with their operation. It is, accordingly, the principal object of my invention to provide a novel and improved mail delivery signal device for mailboxes which obviates deficiencies of such signal devices heretofore devised.

A more particular object of my invention is to provide a mail delivery signal device which is comprised of only two relatively inexpensive parts, and which operates automatically by force of gravity to signal the recipient of the delivery of mail at a signalling position directly underneath, or to either side selectively, of the mailbox when viewed from behind.

Another object is to provide a mailbox delivery signal device of the character described which is well adapted to manufacture and sale as a kit for simplified and easy attachment to ordinary mailboxes.

Yet another object of the invention is to provide a mail delivery signal device which will be simple in construction, inexpensive to install, low in cost, attractive in appearance and long-wearing and dependable in operation.

Other objects, features and advantages of the invention will be apparent from the following description when read in reference to the accompanying drawings. In the drawings, wherein like reference numerals denote corresponding parts throughout the serveral views.

Figure 1:
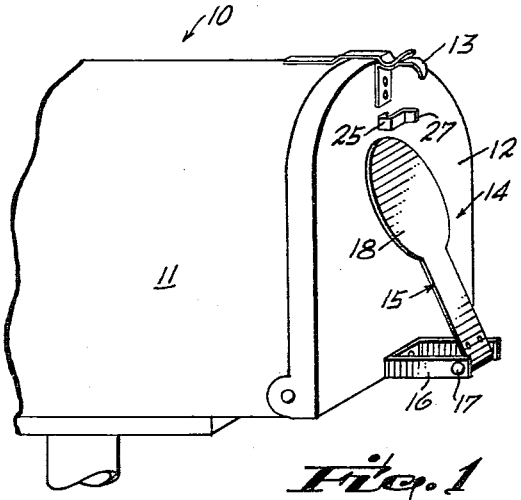
FIG. 1 is a partial view, in perspective view, of the front of an ordinary rural delivery mailbox illustrating attached thereto a mail delivery signal device embodying my invention.
Figure 2:
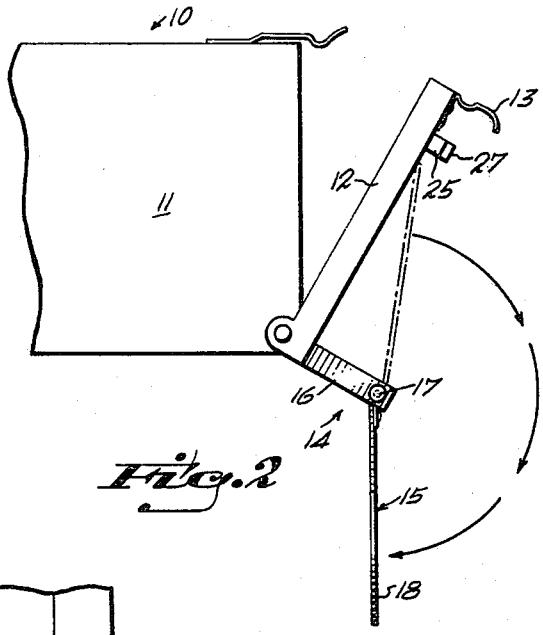
FIG. 2 is a side elevational view of the mailbox illustrated in FIG. 1 showing automatic operation of the device for signaling the delivery of mail upon opening of the door for insertion of the mail.
Figure 5:
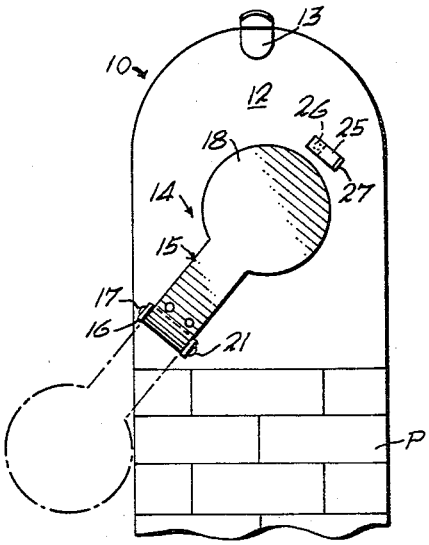
Figure 6:
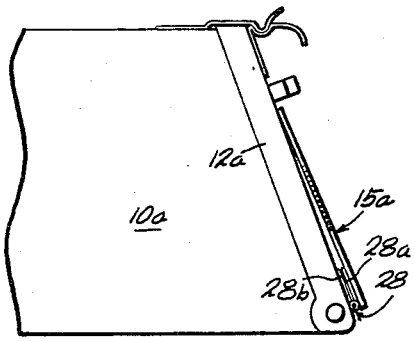

FIG. 5 illustrates how the signal device illustrated in FIGS. 1 and 2 can be attached to the mailbox door at an angle to signal to one side or the other of the mailbox upon delivery in instances where view of the underside of the box is blocked or otherwise obscured; and FIG. 6 illustrates, in side elevation, a modified form of signal device and mailbox assembly providing for simplified construction of the attachment mechanism.

Referring now in detail, to the drawings, reference numeral 10 in FIGS. 1, 2, and 5 designates, generally, a typical sheet metal mail delivery box of the approved type commonly used for rural and off premises mail delivery. As illustrated, such mailboxes comprise an elongated container or housing 11 having a rounded top, the back end of which is closed (not illustrated) and the front end of which can be opened for the insertion of mail by means of a downwardly swingable door 12 appropriately hinged along the bottom for this purpose. A handle 13 is provided at the upper end of the door at the outside thereof to facilitate its opening and closing. Reference numeral 14 designates, generally, a preferred form of a mail delivery signal device embodying the invention, shown in one manner of assembly to the mailbox 10 of FIGS. 1 and 2 as is hereinafter more particularly described.

Figure 3:
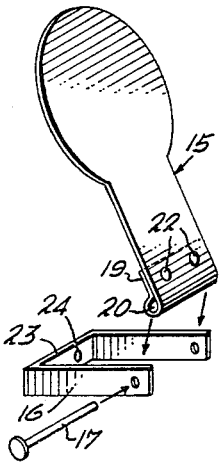
FIG. 3 is an explodes view, in perspective, of the signal device, shown separately.

As illustrated in FIG. 3, the mail delivery signal device 14 comprises an elongated signal arm member 15, a generally U-shaped signal arm bracket 16, and a headed journal pin 17 pivotally supporting said signal arm between opposing end portions of said bracket. The signal arm member 15 and its bracket 16 may be formed of rust resistant sheet metal for strength and durability, although they could also be fabricated of a tough synthetic plastic material. The upper or outer end of the signal arm 15 will preferably be formed with an enlarged head portion 18, which may be circular for example, as illustrated, to better serve as a visual indicator in the manner hereinafter described. For enhanced visability at a distance, the signal arm head portion 18 will be painted or otherwise finished in a bright color, preferably yellow.

Pivotal linkage between the lower or inner end of the signal arm member 15 and bracket 16 may be accomplished by reversely bending a marginal end portion of said signal arm member against itself, as indicated at 19 in FIG. 3, while leaving a rounded transverse bight 20 defining a pivotal opening for through passage of the journal pin 17 upon assembly. After assembly, the inserted end of the headed journal pin 17 will be enlarged by peaning, swedging or the like, to provide an enlargement or head 21. Reversely bent marginal portion 19 may be secured in place either by spot welding or rivets, for example as indicated at 22 in FIG. 3. As means for securement of the mail delivery signal device to a mailbox door, the web or base portion 23 of the signal arm bracket 16 will preferably be provided with a pair of longitudinally-spaced through openings 24, only one illustrated, for the passage of sheet metal screws or other fasteners.

FIGS. 1 and 2 illustrate, typically, how the signal device 14 may be positionally attached to the door 12 of an ordinary mailbox 10. As illustrated, the signal arm bracket 16 is attached, as by sheet metal screws for example, centrally along a lowermost marginal portion of the door 12 so that the signal arm member 15 will lean backwardly to abut at its upper edge against an upper portion of the door when said signal arm member is in its normal, upwardly-directed, non-signaling position. Upon opening the door with use of the handle 13 for the insertion delivery of mail, a position in the downward swinging of the door 12 will be reached, as illustrated in FIG. 2, whereat the center of gravity of the signal arm member 15 will pass to the right of its pivotal axis (as illustrated in FIG. 2) whereupon said signal arm member will fall in an arc from the upper, non-signalling position as represented by the broken-line representation thereof, to the downward-hanging position indicated by the full-line representation thereof, where it will remain until manually returned to the upward position again. It will thus be apparent that nothing need be done by the mailman upon making his delivery to set the signal device in operation, as it is accomplished automatically upon opening of the mailbox door. The signal arm member 15, having swung to its lower, hanging position indicative of mail delivery, can be seen at a distance in this position, thereby notifying the mail recipient that a delivery has been made. After picking up the mail the recipient need only swing it to the upward, non-indicating position again, ready for indicating the next delivery.

Figure 4:
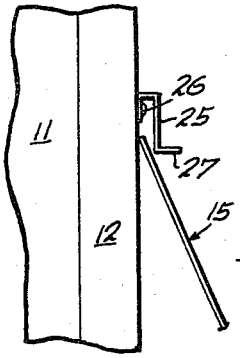
FIG. 4 is a fragmentary view, in side elevation, of the latch mechanism for rendering of the signal device inoperative.

As illustrated in FIGS. 1, 2, and 4 a generally Z-shaped angular rotating latch member 25 may be pivotally secured to the mailbox door just above the resting position of the signal arm member head portion 18 for optional use in rendering the signal device inoperative whenever desired. Thus, as illustrated in FIG. 4, the latch member 25 pivotally attached to the door as by rivet 26 can be manually turned using outwardly-projecting portion 27 as a handle, until it is in overlapping relation with respect to an upper end portion of the signal arm member 15, thereby preventing its falling no matter how far mailbox door 12 is opened. Attachment of the latch member 25 will be such that it will be retained by friction in its adjusted position.

FIG. 5 illustrates a modified installation of the signal device 14 for use in instances where the mailbox is supported on a large pedestal such as a large brick foundation P, for example, so that the line of vision from underneath is obscured. In such instances the signal arm bracket member 25 will be secured at an angle near one or the other corner of the mailbox door so that, upon the opening of the door for the delivery of mail, the signal arm member 15 will fall to one side of the mailbox, rather than under, where it can readily be seen from the rear when viewed from the same side. Thus, as illustrated in FIG. 5, the released signal arm member 15*a* as illustrated by the broken-line representation thereof can readily be seen by an observer behind and to the left of the mailbox, despite the massive pedestal P upon which the mailbox is supported. In a similar manner the signal arm bracket member could be placed in the opposite lower corner of the door to fall to the right and thereby signal a recipient observing from the rear right of the mailbox as illustrated in FIG. 5.

FIG. 6 illustrates a modified form of the invention wherein, instead of using a stand-off signal arm bracket member to achieve backward leaning of the signal arm member 15 as illustrated in FIGS. 1 through 5, the mailbox 10*a* has an inclined front access opening such that the front door 12*a*, instead of being substantially vertical when in closed position, has passed beyond the vertical at an acute angle which will preferably be less than 45 circular degrees. The signal arm member 15*a* can thus be swingably secured along the lower edge of the door 12*a*, or at either corner as described above, with use of an ordinary utility hinge 28. As illustrated, one leaf 28*a* of the utility hinge is secured along the bottom of the signal arm member 15*a*, such as by spot welding for example, and the other hinge leaf 28*b* is affixed to the mailbox door 12*a*, such as by sheet metal screws.

In operation, it will be understood that when in non-signalling position signal arm member 15*a* will lean backwardly against the mailbox door 12*a*. Upon opening the door, when it is swung beyond vertical position in the outward direction, the signal arm member 15*a* will swing about its hinge into the downward or signalling position. It will be understood of course that the hinge 28 will be loose enough about its pivotal axis to permit such free swinging of the signal arm member. As in the embodiment of the invention as illustrated in FIGS. 1 through 5, a rotary latch 25 may be provided for selective use in rendering the signal device inoperative for any reason.

While I have illustrated and described herein only two forms in which my invention can conveniently be embodied in practice, it is to be understood that these forms are presented by way of example only and not in a limiting sense. My invention, in brief, comprises all the embodiments and modifications coming within the scope and spirit of the following claims.

What I claim as new and desire to secure by Letters Patent is:

1. In a mailbox the combination comprising a horizontally-extending housing, an opening at one end of the housing for the placement of mail endwise therein, a closure door hingingly journalled to the housing along the lower end of the housing opening and swingable vertically upwardly against said opening for normally maintaining the housing opening in closed condition, an elongated mail delivery signal arm member, and means for hingingly journalling one end of said signal arm member with respect to a lower front portion of said closure door so as to be swingable between upper and lower positions of rest, the relative positions of said closure door when closed and the journalling axis of said signal arm member journalling means being such that the free end of said signal arm member gravitationally abuts the front of said closure door when said arm member is in its upper position of rest, whereby, upon the downward swinging opening motion of the closure door for the insertion of mail through said opening, the surface portion of said door against which the free end of said signal arm member abuts will be brought to a position forwardly of the vertical plane defined by said signal arm member journalling axis so as to cause said signal arm member to fall automatically to said lower position of rest, and said journalling axis of said signal arm member journalling means further being so inclined as to define an angle with the journalling axis of said closure door, whereby said signal arm member, when in its lower position of rest, projects angularly downwardly and outwardly to one side beyond the outer periphery of said housing when viewed from behind said housing.

2. The invention as defined in claim 1 wherein said housing opening is rearwardly inclined from bottom to top, and said hingingly journalling means for said signal arm member comprises an ordinary hinge member.

3. The invention as defined in claim 1 wherein said housing opening lies in a substantially vertical plane, and wherein said hingingly journalling means for said signal arm member comprises a bracket carrying a laterally off-set journal pin, said journalling axis being defined by said journal pin.

4. The invention as defined in claim 3 wherein said signal arm member is integrally formed, at its free end, with an enlarged head portion for enhanced visibility when said signal arm member is in its lower position of rest or signaling position.

* * * * *